US006862361B2

(12) United States Patent
James et al.

(10) Patent No.: US 6,862,361 B2
(45) Date of Patent: Mar. 1, 2005

(54) AUDIO SPEAKER

(76) Inventors: Floyd John James, 1734 Bowensock, Indian River, MI (US) 49749; David Lewis Clark, 42373 Cotswold Ct., Northville, MI (US) 48167

( * ) Notice: Subject to any disclaimer, the term of this patent is extended or adjusted under 35 U.S.C. 154(b) by 189 days.

(21) Appl. No.: 10/117,485

(22) Filed: Apr. 5, 2002

(65) Prior Publication Data

US 2002/0146145 A1 Oct. 10, 2002

Related U.S. Application Data

(60) Provisional application No. 60/281,867, filed on Apr. 5, 2001.

(51) Int. Cl.[7] ..... H04R 25/00

(52) U.S. Cl. ..... 381/423; 381/424; 381/425; 381/431; 381/432; 381/403; 181/171; 181/173

(58) Field of Search ..... 381/403, 423, 381/424, 425, 431, 432, 427, 404, 405; 181/171, 173, 157, 174, 172

(56) References Cited

U.S. PATENT DOCUMENTS

| | | | | |
|---|---|---|---|---|
| 4,252,211 A | | 2/1981 | Matsuda et al. | |
| 5,847,333 A | * | 12/1998 | D'Hoogh | 181/171 |
| 6,095,280 A | | 8/2000 | Proni | |

FOREIGN PATENT DOCUMENTS

| | | | | |
|---|---|---|---|---|
| GB | 321430 | * | 11/1929 | 381/423 |

* cited by examiner

*Primary Examiner*—Curtis Kuntz
*Assistant Examiner*—Tuan Duc Nguyen

(57) ABSTRACT

An audio speaker including a chassis and a diaphragm defining an axis. A suspension movably interconnects the diaphragm and the chassis for reciprocating movement of the diaphragm along the axis. A motor is operably connected to the diaphragm for powered movement thereof. The diaphragm includes a cylindrical flange extending from its peripheral edges axially in the direction of the motor. The termination of said cylindrical flange provides an attachment for an annular rear flexible suspension member that, in turn, attaches to the frame.

5 Claims, 6 Drawing Sheets

AUDIO SPEAKER

CROSS-REFERENCE TO RELATED APPLICATION

The present application claims the benefit of U.S. Provisional Application No. 60/281,867, filed on Apr. 5, 2001, the entire contents of which are hereby incorporated by reference.

BACKGROUND OF THE INVENTION

Various types of loud speaker driver units generate sound in response to an electrical signal to the speaker have been developed. Known loud speakers include a motor that acts as a transducer of electrical energy to mechanical energy. A radiating diaphragm then transduces the mechanical energy into acoustical energy. With reference to FIG. 1, a conventional audio speaker 1 includes a cone-shaped diaphragm 2 that is operably interconnected with a chassis 3 via a suspension system such as a flexible surround 4. The speaker 1 includes an inner suspension consisting of a flexible member commonly referred to as a "spider" 5. The rear or inner suspension may also be referred to as a "damper". A voicecoil 6 is formed of wire wound around a voicecoil former 7. The former 7 is also commonly referred to as a "bobbin". Terminals 9 are secured to the frame 3, and are electrically interconnected to the voicecoil 6 via flexible leads 8. The flexible leads 8 are also commonly referred to as "tinsel leads". A magnetic assembly 10 includes a ring magnet 11 and center pole 12 that are secured to a back plate 13.

Prior art low frequency loud speakers, or woofers, such as illustrated in FIG. 1, are typically quite deep, such that the speakers may take up a substantial amount of space. The depth is the result of the stack up of dimensions of cone depth, cone apex to magnet top plate clearance, clearance for attachment and operation of the rear suspension, voicecoil length, clearance for rear of the voicecoil to the magnet back plate, and back plate thickness. The clearance dimensions and voicecoil length are largely determined by the maximum rearward excursion required for a particular design. The diaphragm of a loud speaker converts the force generated by the motor to acoustical radiation. All else being equal, the larger the radiating area of the diaphragm, the greater the acoustical output. In addition, all else being equal, the greater the axial excursion of the diaphragm, the greater the acoustical output. The requirements for area and excursion for a given output increase quickly as frequency decreases. These requirements have led to large woofers with long excursion capability.

In general, there are three primary loads on the diaphragm against which the voicecoil force is applied. First, acceleration of the diaphragm and air masses, and part of the suspension. Second, a load results from the compression or rarefaction of the air volume of the system enclosure. Third, compression and extension of the spring stiffness of the outer suspension also generates a load on the diaphragm. In general, the load of the radiated acoustic power for a direct radiating woofer is negligibly small.

These loads cause the diaphragm to flex, thus causing a loss of acoustic radiation, and potentially causing structural failure. Acceleration and air compression loads are distributed over the entire area of the diaphragm rather than being concentrated in a small area. On the other hand, drive force from the voicecoil and load from the perimeter suspension mass and spring stiffness are applied at inner and outer rings of high force concentration. Accordingly, these rings must be designed to prevent structural failure.

In prior art cone or thin parallel plate flat diaphragm type speakers, reinforcing coupling members may be required to spread the force from the motor. Such reinforcing is generally not required at the outer perimeter of the diaphragm because the attached mass is low and the length of attachment is relatively great. Nevertheless, delamination of cone paper or separation of skin from the core of the diaphragm may occur in such speakers.

In many applications, a system enclosure may easily accommodate a woofer having a relatively large depth. However, for other applications, a woofer having a relatively large depth may take up an unacceptably large amount of space. Examples of such applications include car doors, in-wall, and under-seat woofers. Thus, a speaker having relatively poor low frequency capability may ultimately be used in such applications due to the space constraints.

Several approaches have been tried in an attempt to provide a low frequency speaker having a shallow overall dimension. One approach involves reducing the depth of the diaphragm cone. However, this approach results in increased cone flexure, which can lead to failure and loss of effective volume displacement. Also, a relatively flat cone also has less resistance to axial tilt because the surround and spider are moved closer together, reducing the lever arm that resists tilt. Excess axial tilt may cause the voicecoil to contact the magnet poles, causing distorted sound and reduced reliability. Another approach involves reducing excursion to allow reduction of clearance in the axial direction, thereby providing low frequency speaker that is relatively shallow. However, this approach results in a direct sacrifice of performance for the reduced depth due to the reduced excursion. Yet another approach that has been attempted utilizes an inverted motor that places the magnetic assembly and voicecoil inside the cone, thus utilizing previously unused space. However, a substantial extension of the voicecoil former is necessary to provide clearance between the front cone surface and the front surface of the top plate of the magnet assembly. This results in the magnet assembly being positioned forward in the cone, such that it protrudes beyond it, thus increasing depth.

SUMMARY OF THE INVENTION

One aspect of the present invention is an audio speaker including a chassis and a diaphragm defining an axis. A suspension movably interconnects the diaphragm and the chassis for reciprocating movement of the diaphragm along the axis. A motor is operably connected to the diaphragm for powered movement thereof. The diaphragm includes front and rear skins, and at least a portion of the skins have a generally conical shape. The skins define outer peripheral edges, and are interconnected at the outer peripheral edges with the conical shapes oriented in opposing directions to form a cavity between the skins having an enlarged central portion tapering to a thinner peripheral portion adjacent the outer peripheral edges of the skins. The cavity is at least partially filled with a lightweight core material to support the front and rear skins.

Another aspect of the present invention is an audio speaker including a chassis, a diaphragm, and a suspension movably supporting the diaphragm in the chassis. A motor is operably connected to the diaphragm for powered movement of the diaphragm. The diaphragm includes a generally tubular voicecoil former and front and rear skins secured to the voicecoil former and extending radially outwardly therefrom. The front and rear skins have a truncated cone shape with an inner peripheral edge secured to the voicecoil former. Each of the front and rear skins define outer peripheral edges, and the outer peripheral edges of the front and rear skins are positioned adjacent one another with the cone shapes of the skins oppositely oriented to form a cavity.

Yet another aspect of the present invention is an audio speaker including a chassis, and a diaphragm having a main body portion defining a generally circular outer perimeter and a center plane. The main body portion defines outer surfaces that are substantially symmetric about the central plane. The diaphragm includes a ring-like flange extending from the outer perimeter generally perpendicular to said center plane. A first suspension member is secured to the diaphragm adjacent to the outer perimeter and movably interconnects the diaphragm to the chassis. A second suspension member is secured to the ring-flange and movably interconnects the diaphragm to the chassis. The speaker includes a motor operably connected to the diaphragm for powered movement thereof.

These and other features, advantages, and objects of the present invention will be further understood and appreciated by those skilled in the art by reference to the following specification, claims, and appended drawings.

DETAILED DESCRIPTION OF PREFERRED EMBODIMENT

Figure 1:
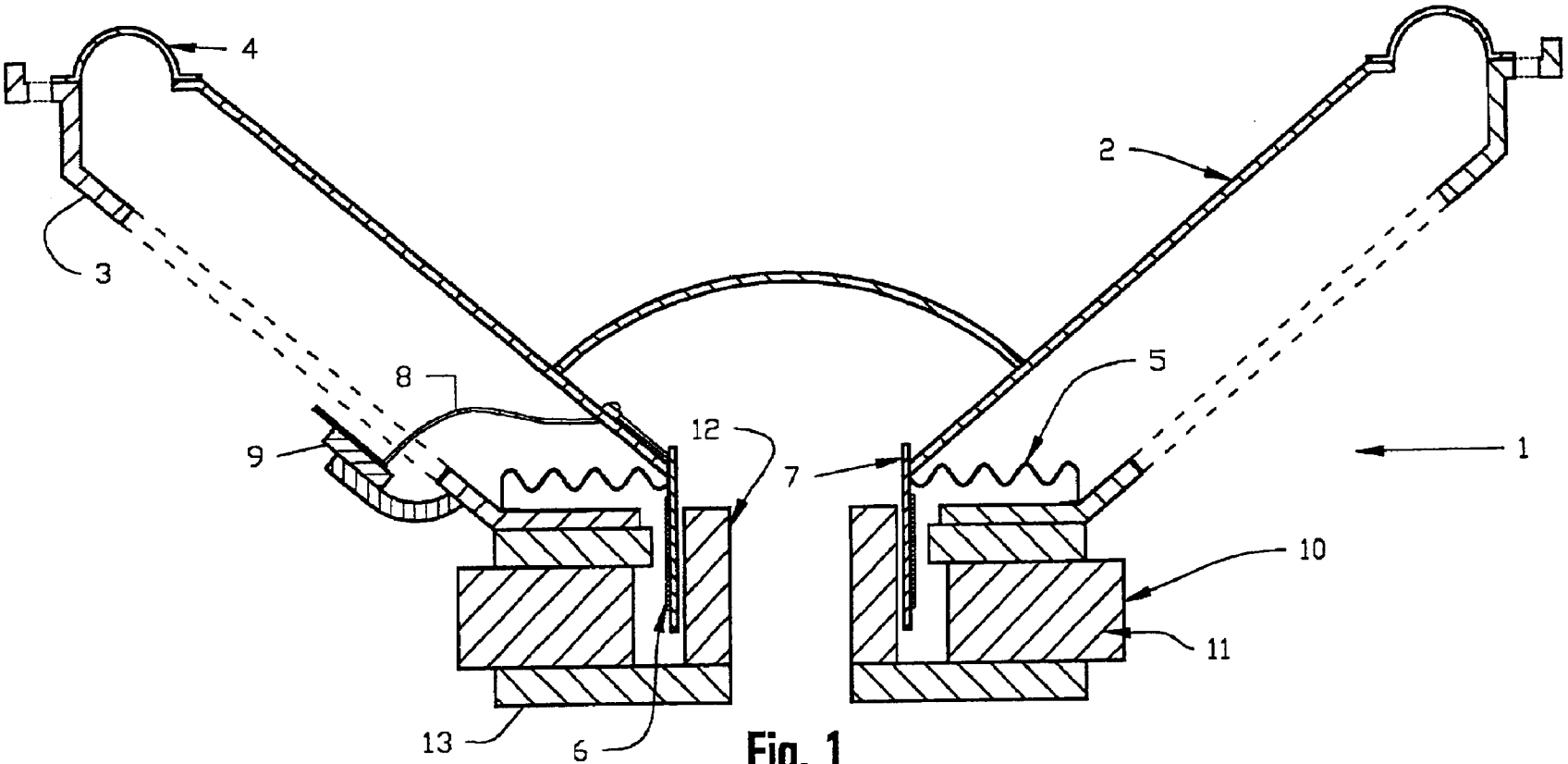
Fig. 1 Prior Art
FIG. 1 is a cross-sectional view of a prior art audio speaker having a cone-shaped diaphragm.
Figure 2:
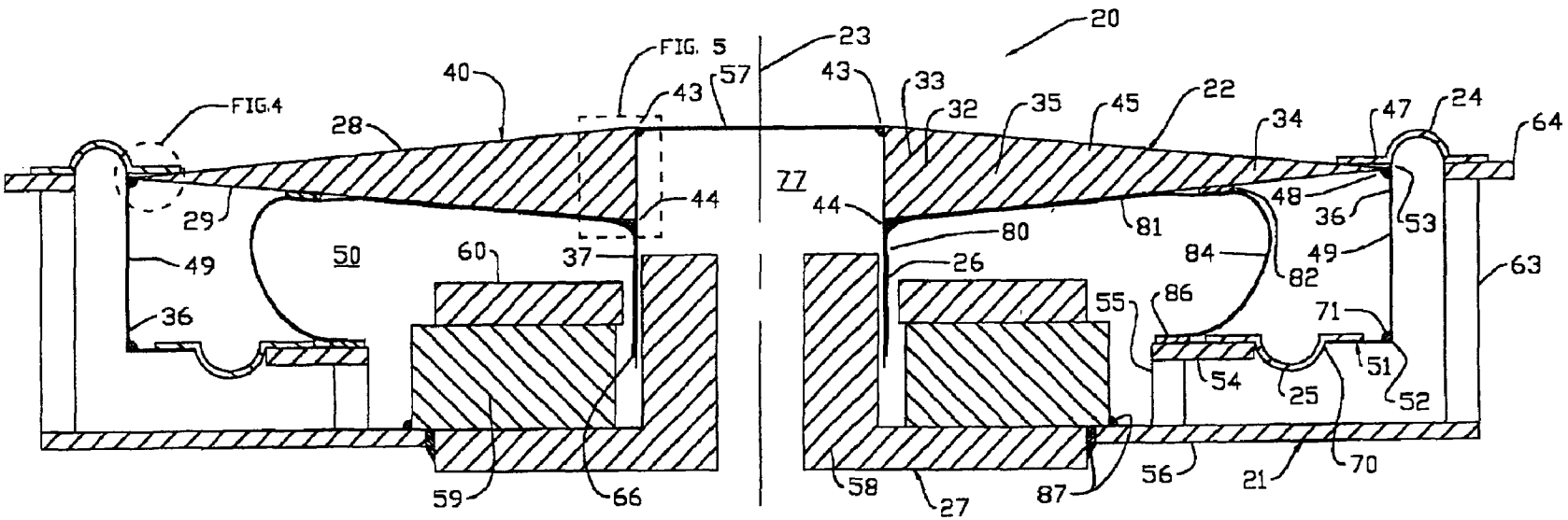
FIG. 2 is cross-sectional view of a speaker according to the present invention, which is particularly suited for applications requiring a speaker having minimal depth.

For purposes of description herein, the terms "upper," "lower," "right," "left," "rear," "front," "vertical," "horizontal," and derivatives thereof shall relate to the invention as oriented in FIG. 2. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 20 (FIG. 2) generally designates an audio speaker embodying the present invention, which is particularly suited for applications requiring a flat speaker having low frequency sound-generating capabilities. The speaker 20 includes a chassis 21 and a diaphragm 22 defining an axis 23. In the illustrated example, the suspension includes a first flexible member such as outer suspension member 24, and a second flexible member such as inner suspension member 25 that movably interconnect the diaphragm 22 and the chassis 21 for reciprocating movement of the diaphragm 22 along the axis 23. A motor includes a voicecoil 26 and magnet assembly 27, and the motor is operably connected to the diaphragm 22 for powered movement thereof. The diaphragm 22 includes a front skin 28 and a rear skin 29. At least a portion of the skins 28 and 29 have a generally conical shape, and the skins 28 and 29 define outer peripheral edges 30, 31 (see also FIG. 4). The skins 28 and 29 are interconnected at the outer peripheral edges 30, 31 with the conical shapes oriented in opposing directions to form a cavity 32 between the skins having an enlarged central portion 33 tapering to a thinner peripheral portion 34 adjacent the outer peripheral edges 30, 31 of skins 28 and 29, respectively. The cavity 32 is at least partially filled with a lightweight core material such as foam 35 to support the skins 28 and 29.

Figure 3:
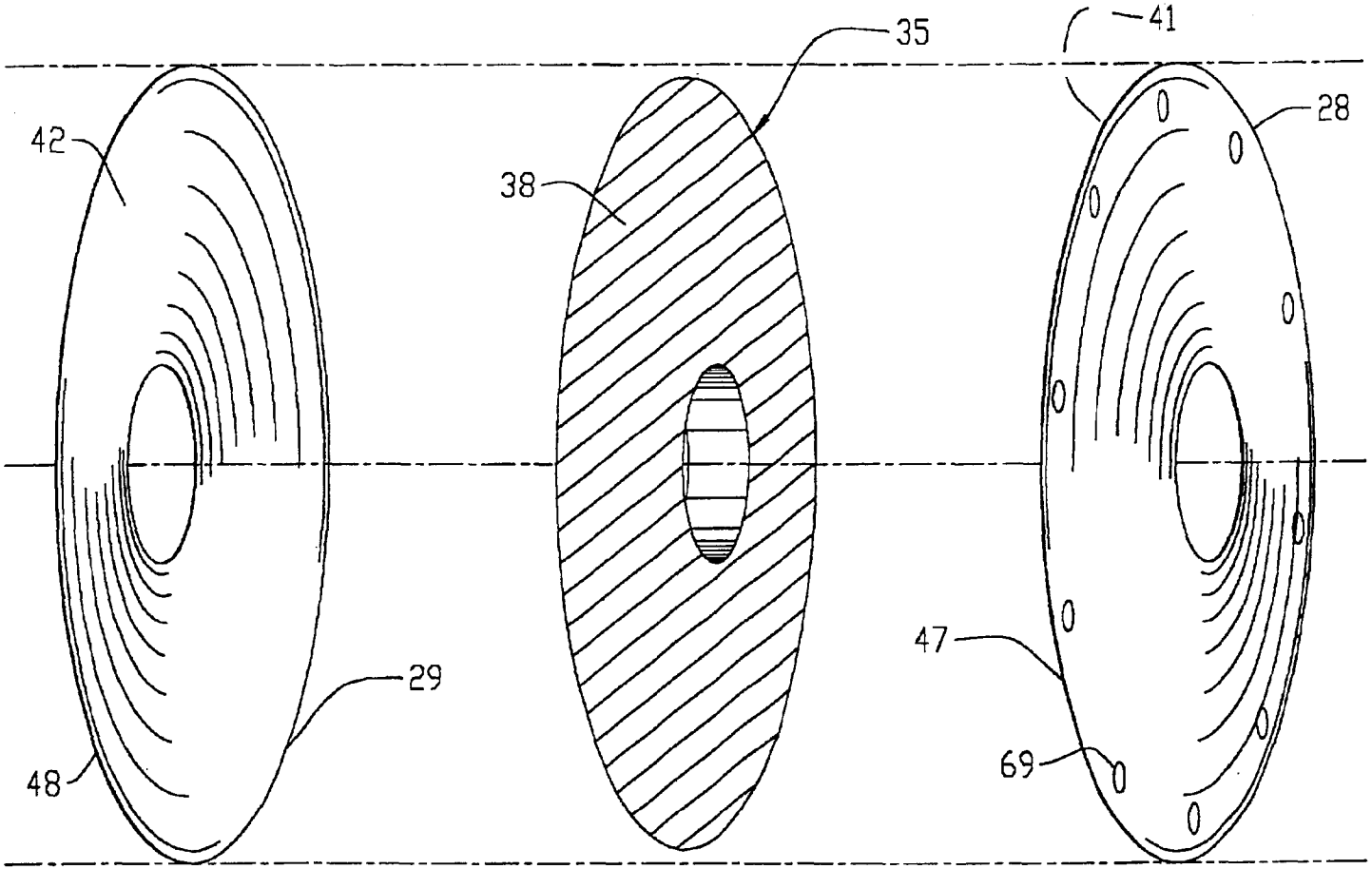
FIG. 3 is a perspective view illustrating the front and rear skins and foam core of the speaker of FIG. 2.

In a preferred embodiment, the front and rear skins 28 and 29, respectively, are made from a 0.004" thick 1145 H19 alloy. However, other alloys or materials having the required strength and weight characteristics may also be utilized. The foam core 35 is made from a lightweight rigid foam such as a Rowhacell Polymethacrylimide "PMI" available from Rohm Corp., or an Expanded Polystyrene "EPS" material. The outer surface 38 of foam core 35 (see also FIG. 3) closely conforms to the inner surfaces 41 and 42 of skins 28 and 29, respectively, such that no gaps are formed between the foam core 35 and skins 28 and 29. The skins 28 and 29 are adhesively bonded to the foam core 35, thereby providing a lightweight rigid structure. The diaphragm assembly 22 includes a generally tubular voicecoil former or bobbin 37 that is secured to the inner peripheral edges 43 and 44 of conically-shaped skins 28 and 29, respectively. As best seen in FIG. 2, this arrangement provides a very lightweight rigid structure, with the disk-like central portion 45 of the diaphragm 22 having a triangular cross-sectional shape that resists bending and distortion that would otherwise occur during operation of the speaker 20.

The diaphragm 22 includes a ring-like collar 36 that is secured to the disk-like central portion 45 adjacent the outer peripheral edges 47 and 48 of skins 28 and 29, respectively. The collar 36 is made from a fiberglass material, and includes a plurality of vent holes 49 therethrough to ensure that pressure differentials within the central space 50 do not develop that would otherwise adversely affect operation of the speaker. A collar flange 25 is secured to the circular peripheral edge 52 of collar 36. A plurality of suspension standoffs 55 extend upwardly from the magnet flange 56, and an inner suspension flange 54 extends outwardly therefrom. The inner suspension member 25 is secured to the collar flange 51 and the inner suspension flange 54 to thereby movably interconnect the diaphragm assembly 22 to the chassis 21. Magnet assembly 27 includes a T-yoke 58, a ceramic magnet 59, and at top plate 60. The chassis 21 includes mounting flange standoffs 63 that supports mounting flange 64. Outer suspension member 24 is secured to the disk-like central portion 45 of diaphragm assembly 22 adjacent the outer peripheral edges 47 and 48 of skins 28 and 29, respectively.

The speaker 20 of the present invention alleviates numerous disadvantages associated with prior speakers, and reduces thickness to only that required by the motor structure and operation clearances, plus the thickness of the shallow radiating diaphragm. As discussed above, the loads acting on a diaphragm will tend to cause the diaphragm to flex, thus causing a loss of acoustic radiation and potentially causing structural failure in prior art diaphragms. In general, acceleration and air compression loads are distributed over the entire area of a speaker diaphragm rather than being concentrated in a small area. In contrast, the drive force from the voicecoil and load from the perimeter suspension mass and spring stiffness are applied at inner and outer rings of relatively high force concentration. The diaphragm of the present invention addresses these structural concerns by means of its unique cross section. As is apparent from the cross section of FIG. 2, the voicecoil former or bobbin 37 drives a cylindrical area bounded by the front and rear skins 28 and 29. Preferably, the voicecoil former 37 is adhesively bonded to the foam core 35 across the entire cylindrical surface 39 of between the skins 28 and 29 to transmit loads between the skins and the voicecoil former 37 through the foam. Furthermore, as described in more detail below, the skins 28 and 29 are securely attached to the voicecoil former 37, such that forces are also transmitted between the skins 28 and 29 and the voicecoil former 37. The perimeter 53 of the disk-like central portion 45 of diaphragm assembly 22 at the junction of the skins 28 and 29 forms a structurally rigid load-bearing circle around the length of the perimeter 53 of the diaphragm assembly 22. This structure serves to drive the mass of the axial extension of the diaphragm assembly 22 and the partial masses of the two suspension members 24 and 25. The structure also drives the stiffness of both suspension springs.

As seen in FIG. 2, the skins 28 and 29, in conjunction with the voicecoil former 37 form a shallow triangle of high modulus material. This truss-like arrangement causes the drive force applied to the voicecoil former 37 to generate compression stress in one skin, and tension stress in the other. The lightweight foam core 35 maintains the shape of the skins 28 and 29 when undergoing compression, thus preventing buckling. In a preferred embodiment, the skins present an area in excess of 15 square mm each at the attachment of the preferred embodiment, such that flex of the central portion 45 of the diaphragm is minimal thereby providing improved audio characteristics. In the preferred embodiment, the combination of voicecoil diameter, diaphragm diameter, core thickness at the voicecoil attachment, and skin thickness are optimized to carry diaphragm mass, axial extension mass, enclosure air compression and expected suspension load under excursion snubbing conditions. Optimized structural designs according to the present invention easily come in under requirements for a maximum moving mass for a particular application. The voicecoil former 37 includes an axial extension portion 66. Because the voicecoil former 37 and axial extension portion 66 are cylindrical or a cone of very narrow included angle, the forces are almost entirely compression or extension. A very thin and light member is adequate for carrying this force with negligible distortion. The shape is maintained under compressive stress by the curvature inherent in the extension following the curve of the perimeter of the radiating portion of the diaphragm 22.

As discussed above, the unique diaphragm assembly 22 is comprised of a disk-like central diaphragm portion 45, collar 36, voicecoil former 37, and dustcap 57. During fabrication, aluminum skins 28 and 29 can be stamped into shape or formed by slitting and overlapping a donut shaped piece of foil. Foam core 35 can be machined from a lightweight rigid foam such as PMI or molded from Expanded polystyrene ("EPS") foam. The skins 28 and 29 must precisely match the shape of the core 35 for optimum strength. If the foam core 35 is machined or molded, it is generally not practical to reduce the edge to a very sharp point because the edge would be fragile and difficult to handle without chipping. A vertical edge 67 (see also FIG. 4) of approximately 0.75 mm is practical with PMI, and more may be required with the EPS molding process.

Figure 4:
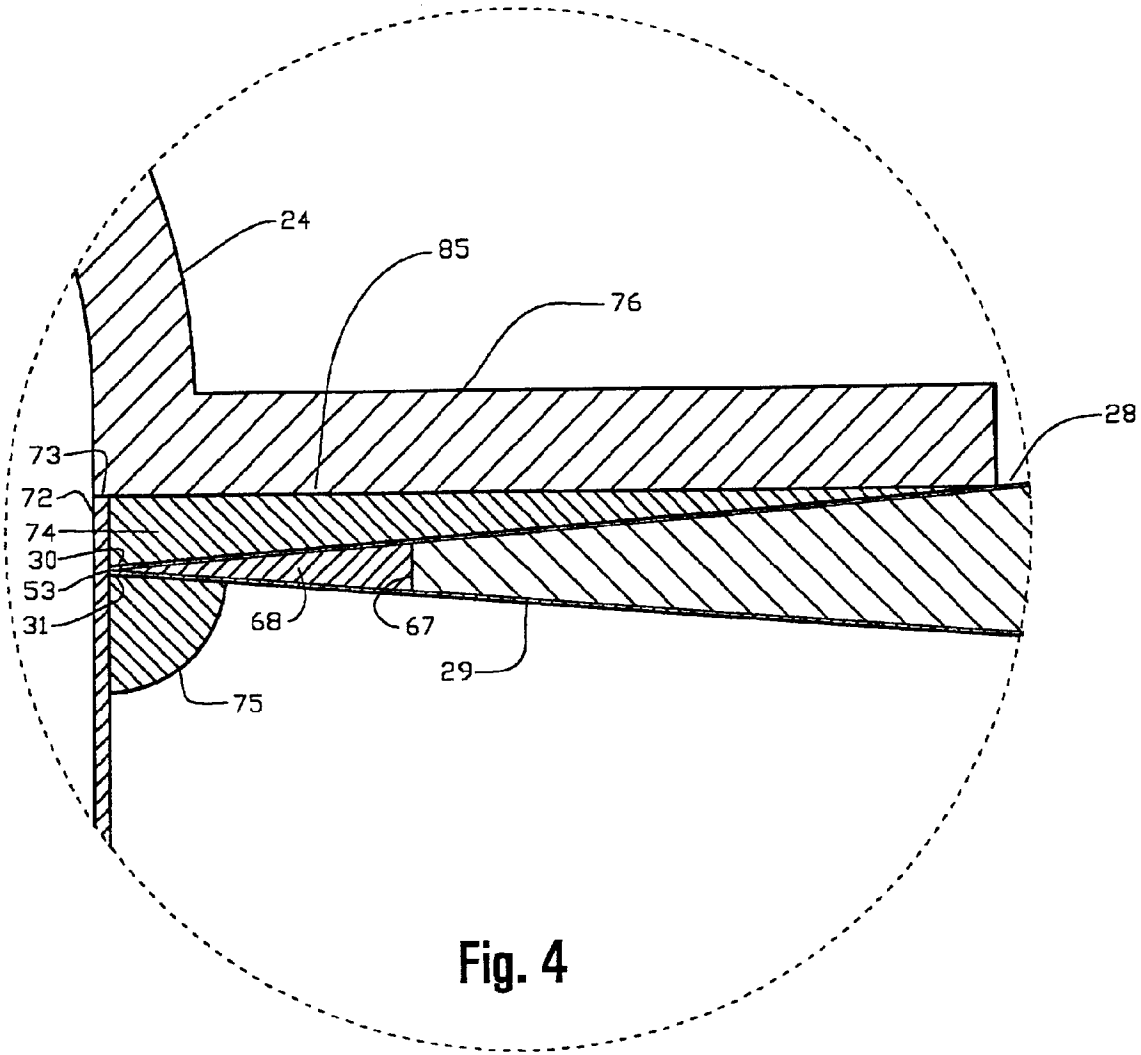
FIG. 4 is an enlarged view of the peripheral edge portion of the diaphragm of the speaker of FIG. 2.

Attaching the skins 28 and 29 to the foam core 35 can be done with a spray contact adhesive or an adhesive film such as 3M very high bond ("VHB"). FIG. 4 illustrates the use of gap filling epoxy 68 to fill the space where the skins 28 and 29 meet at the perimeter 53 of the disk-like central portion 45 of the diaphragm. The composite diaphragm may be fabricated by providing skins 28 and 29 with a plurality of perimeter vent holes (see also FIG. 3) through skin 28 and/or 29. The skins 28 and 29 are then put into a fixture and an expandable Polyurethane foam is injected into the cavity. The inner walls of the skins 28 and 29 are primed to provide the necessary adhesion between the expanded Polyurethane foam and the skins 28 and 29. It is possible to integrate the attachment of the skins 28 and 29 in the EPS molding process by placing the skins in the mold before the EPS beads are injected. Additional perimeter vent holes are required if this technique is utilized.

The collar 36 is preferably formed from fiberglass sheet having an epoxy resin matrix. This fiberglass material provides the necessary glue adhesion properties. During fabrication, vent holes 49 are first punched in a long strip of the fiberglass. The strip is then bent to form a ring-like circle. The ends of the fiberglass strip are overlapped and glued together. The I.D. of the collar 36 is the same as the O.D. of the central portion 45 of the diaphragm to allow a press fit for the gluing process. The collar flange 51 is preferably a ring of the same fiberglass material as collar 36 having an O.D. that is the same as the I.D. of the collar 36. The I.D. of the collar flange 51 is the same as the outside edge 70 of the half roll on the inner suspension member 25. The collar flange 51 is held in place at the lower edge of the collar and glued with a bead of structural epoxy 71 such as Devcon Epoxy Plus ("DEP") 25.

The joining of the central portion of diaphragm 45 and collar 36 is illustrated in FIG. 4. The central portion of diaphragm 45 is positioned inside the end 72 of the collar 36 opposite the collar flange 51 at a distance of 0.040" below the edge 73 of collar 36. A bead 75 of DEP is placed at the junction of collar 36 and diaphragm skin 22. The assembly is then placed with the diaphragm up. A low viscosity epoxy 74 with fumed silica micro spheres for light weight is used to fill the 0.040" gap between skin 28 and the edge portion 76 of outer suspension member 24, and to level the area for mating with the outer suspension member 24. The epoxies 68 and 74 along with collar 36 capture the outer edge 53 of the diaphragm to form strong structural joint.

Figure 5:
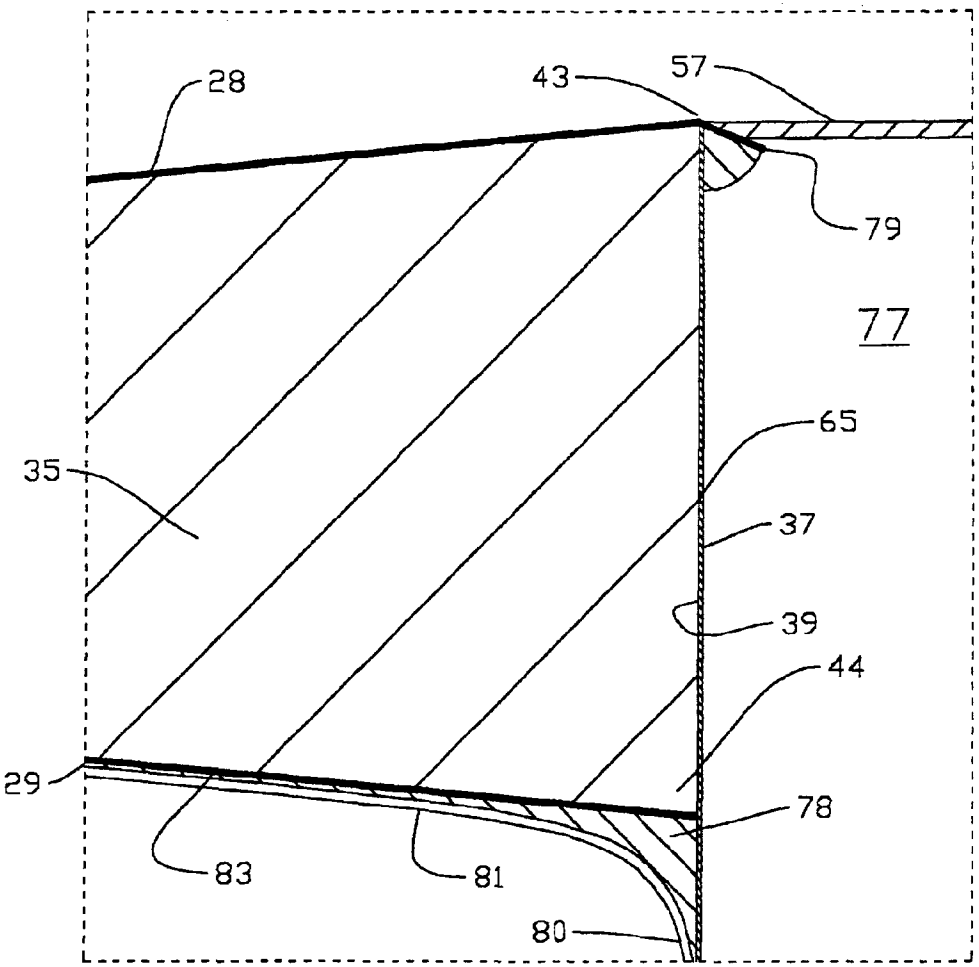
FIG. 5 is an enlarged view illustrating the interconnection of the front and rear skins and the inner portion of the tubular voicecoil former.

With reference to FIG. 5, the diaphragm assembly 22 is completed by positioning voicecoil former 37 in the bore 77 of central portion 45 of the diaphragm and gluing it in place. The entire inner surface 65 of foam core 35, as well as the outer surface 39 of the voicecoil former 37 is coated with DEP 55 before being inserted into the bore 77 of the central portion 45 of the diaphragm. This insures that any open cells in the foam are filled. A bead of epoxy 78 forms as the voicecoil former 40 is inserted into the diaphragm. This bead is then formed into a fillet so as to avoid reducing backstroke clearance. A crimping tool (not shown) is used to form a small flange 79 on the inner peripheral edge 43 of the outer skin 28 to provide a mounting surface for the dust cap 57. The dust cap is glued in place utilizing a suitable adhesive.

The voicecoil leads 81 are then glued to the outer wall 80 of the voicecoil former 37 and glue fillet 78 with a medium viscosity fast-setting epoxy. The leads 81 are then slid into Teflon tubing and glued to the outer surface 83 of inner skin 29 with a room temperature vulcanizing ("RTV") silicone adhesive. The voicecoil lead 81 and tinsel lead 84 are then soldered to the tinsel pad 82. The pad 82 is then clued to the inner skin 29 with a toughened instant adhesive such as Loctite Black Max 380.

The suspension members 24 and 25 are then adhesively bonded to assemble the diaphragm assembly 22 with the chassis 21. The adhesive used to bond the suspension members 24 and 25 is preferably clear for appearance sake, flexible so it is compatible with the suspension foam, and low viscosity for proper voicecoil alignment. This adhesive should also be capable of bonding with a thermoset polyester resin powder coat finish on the mounting flange 64 and inner suspension flange 54. An example of a preferred adhesive is a two-part high performance urethane adhesive U-10FL made by Loctite. This adhesive is temperature sensitive and must be kept at about 75° F. during curing. The adhesive 85 (FIG. 4) is applied to the inner perimeter lip 76 of the inner suspension member 25 which is folded and placed inside the collar and allowed to self-center on the collar flange 51. The outer suspension 24 is attached to the diaphragm assembly using the same urethane adhesive, but generally requires a fixture (not shown) to maintain proper alignment while the adhesive cures. The diaphragm assembly 22 is then ready to be placed in the chassis 21 for final assembly.

To begin the assembly of the chassis 21, the magnet subassembly consisting of T-yoke 58, ceramic magnet 59, and the top plate 60 is glued into the magnet flange 56 with a fixture (not shown) that ensures concentricity with voicecoil gap. An adhesive such as Loctite H3000 acrylic epoxy 87 is preferably used to adhere the powder coated magnet flange 56 to the T-yoke 58 and ceramic magnet 59. Inner suspension flange 54 and inner suspension standoffs 55 are mounted via machine screws or other suitable standard fasteners (not shown). Mounting flange 64 and mounting flange standoffs 63 are also mounted with machine screws. Flange pad 86 is glued to the inner suspension flange 54 with a surface insensitive instant adhesive such as Loctite 401.

Figure 6:
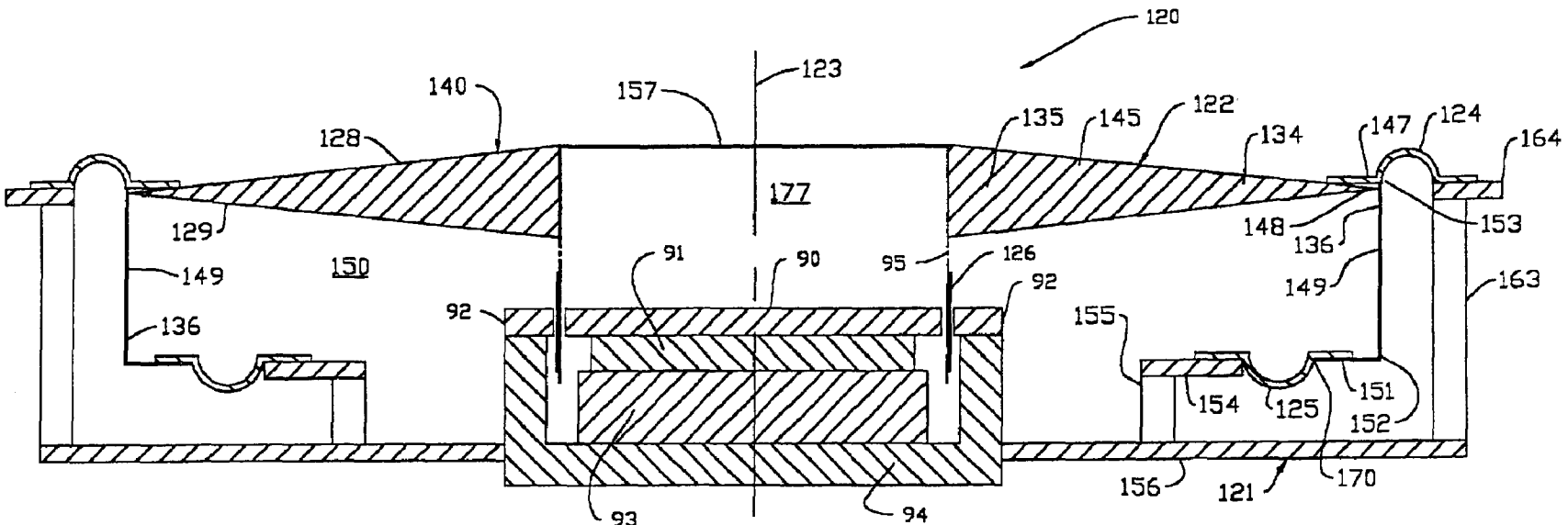
FIG. 6 is a cross-sectional view of another embodiment of a speaker according to the present invention utilizing a neodymium magnet.

Another embodiment of the speakers illustrated in FIG. 6. The speaker illustrated in FIG. 6 is substantially similar to the speaker described in detail above, except that the speaker of FIG. 6 utilizes a neodynium magnet. Corresponding features have the same part numbers as the speaker of FIGS. 2–5, except that the number 100 has been added. The magnet assembly illustrated in FIG. 6 includes a top plate 90, a neodynium magnet 91, a return coupler 93, a back plate 94, and a top plate ring 92. Magnet 91 has a northpole on its upper surface, and the magnetic field is transferred throughout the top plate 90. The southpole of the magnet is couple through the return coupler 93 to the back plate 94, and up to the top plate ring 92. The magnetic fluce is thereby concentrated in the gap between the top plate 90 and the top plate ring 92. A plurality of vent holes 95 extending around the voicecoil reduce/eliminate pressure differentials that could otherwise interfere with the operation of the diaphragm. The neodynium magnet assembly provides a substantially improved power to weight ratio relative to conventional magnet assemblies.

The unique disk-shaped diaphragm of the audio speaker of the present invention provides a very lightweight, stiff, and strong structure that permits a very low profile speaker. Significantly, the diaphragm permits construction of a low profile speaker having low frequency capability. Thus, advantageously, the speaker of the present invention can be utilized in applications wherein space constraints prevent use of a conventional woofer.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. An audio speaker, comprising:

a chassis;

a diaphragm defining an axis;

a suspension movably interconnecting said diaphragm and said chassis for reciprocating movement of said diaphragm along said axis;

a motor operably connected to said diaphragm for powered movement thereof; and wherein:

said diaphragm includes first and second skins, at least a portion of at least one said skin having a generally conical shape, and each said skin defines outer peripheral edges, said skins being interconnected at said outer peripheral edges, said conical shape oriented to form a cavity between said skins having an enlarged central portion tapering to a thinner peripheral portion adjacent said outer peripheral edges, said diaphragm including lightweight core material at least partially filling said cavity and supporting said front and rear skins is constructed to substantially maintain its shape while undergoing the reguired axial excursions to produce sound, said diaphragm includes a cylindrical flange extending parallel to said axis from the outer peripheral edge of said diaphragm to partially surround said motor, and wherein said suspension includes a first flexible suspension member secured to said chassis and to said diaphragm adjacent said outer peripheral edge, said suspension further including a second flexible suspension member secured to said chassis and to said cylindrical flange.

2. The audio speaker of claim 1, wherein: said cylindrical flange defines a circular edge spaced apart from said outer peripheral edges of said first and second skins, said second flexible suspension member secured to said cylindrical flange adjacent said circular edge and extending inwardly towards said axis defined by said diaphragm.

3. The audio speaker of claim 2, wherein: said diaphragm includes a cylindrical flange extending from said outer peripheral edges, said cylindrical flange being concentric with a tubular voicecoil former axis; and said suspension including a flexible member extending radially inwardly from said cylindrical flange.

4. The audio speaker of claim 3, wherein: said cylindrical flange includes a plurality of perforations therethrough.

5. The audio speaker of claim 4, wherein: said cylindrical flange is made of a fiberglass material, said cylindrical flange being adhesively bonded to said rear skin adjacent an outer perimeter of said diaphragm.

* * * * *